US005706725A

United States Patent [19]

Kolbe et al.

[11] Patent Number: 5,706,725

[45] Date of Patent: Jan. 13, 1998

[54] FLEXOGRAPHIC PRINTING PRESS WITH VARIABLE PRINTING LENGTH

[75] Inventors: Wilfried Kolbe, Gülzow; Manfred Terstegen, Bielefeld; Bodo Steinmeier, Bielefeld; Klaus Schirrich, Bielefeld, all of Germany

[73] Assignee: Fischer & Krecke GmbH & Co., Bielefeld, Germany

[21] Appl. No.: 750,889

[22] PCT Filed: Apr. 3, 1996

[86] PCT No.: PCT/EP96/01452

§ 371 Date: Dec. 18, 1996

§ 102(e) Date: Dec. 18, 1996

[87] PCT Pub. No.: WO96/38304

PCT Pub. Date: Dec. 5, 1996

[30] Foreign Application Priority Data

May 30, 1995 [DE] Germany ..... 195 19 141.2

[51] Int. Cl.[6] ..... B41F 5/00

[52] U.S. Cl. ..... 101/216; 101/248; 101/349; 101/178

[58] Field of Search ..... 101/178, 170, 101/151, 211, 216, 218, 219, 220, 248, 349, 350

[56] References Cited

U.S. PATENT DOCUMENTS

| | | | |
|---|---|---|---|
| 2,128,343 | 8/1938 | Bemis et al. | 101/178 |
| 2,170,286 | 8/1939 | Hintze et al. | 101/178 |
| 2,869,459 | 7/1959 | Böhme | 101/178 |
| 3,163,109 | 12/1964 | Stelling, Jr. | 101/178 |
| 4,651,641 | 3/1987 | Kawata et al. | 101/220 |
| 5,009,158 | 4/1991 | John et al. | 101/219 |
| 5,010,813 | 4/1991 | Buffo | 101/216 |
| 5,447,101 | 9/1995 | Weis | 101/219 |

FOREIGN PATENT DOCUMENTS

| | | |
|---|---|---|
| 0459098 | 12/1991 | European Pat. Off. . |
| 0498012 | 8/1992 | European Pat. Off. . |
| 2550995 | 3/1985 | France . |
| 3336792 | 3/1986 | Germany . |
| 2283939 | 5/1995 | United Kingdom . |

*Primary Examiner*—Eugene H. Eickholt
*Attorney, Agent, or Firm*—Richard M. Goldberg

[57] ABSTRACT

A flexographic printing press with one or several color printing units (12), which are disposed at the periphery of a common back pressure cylinder (10) and, in each case, have an impression cylinder (14; 14') and an applicator roll (16) and the impression cylinder of which can be driven independently of the back pressure cylinder, characterized in that each applicator roll (16) can be driven over a gear assembly (32, 40; 32') with a fixed transmission ratio by a central wheel (24) fixed on the shaft (22) of the back pressure cylinder (10).

8 Claims, 1 Drawing Sheet

FLEXOGRAPHIC PRINTING PRESS WITH VARIABLE PRINTING LENGTH

BACKGROUND OF THE INVENTION

The invention relates to a flexographic printing press.

Flexographic printing presses usually have several color printing units, which are disposed at the periphery of a common back pressure cylinder and in each case have an impression cylinder as well as an applicator roll. The function of the applicator roll is to ink the block on the impression cylinder. For this purpose, the applicator roll typically has on its surface a uniform grid of cells, which are filled with printing ink with the help, for example, of a "Kammerakel" (literally: comb doctor blade). The applicator roll with the ink-filled cells rolls along the periphery of the impression cylinder and transfers the ink to the raised, printing parts of the block. For this purpose, it is important for the applicator roll and the impression cylinder to have exactly the same circumferential speed, so that the ink is not smudged as it is being applied on the impression cylinder. Usually, this accomplished owing to the fact that, seated on the shaft of the applicator roll, there is an applicator roll gearwheel, which meshes with an impression cylinder gearwheel seated on the shaft of the impression cylinder, the diameter of the rolling circle of the applicator roll gearwheel being equal to the external diameter of the applicator roll and the rolling circle diameter of the impression gearwheel being equal to the external diameter of the impression cylinder.

The material to be printed is looped about the greater part of the periphery of the back pressure cylinder, so that there is practically no slippage between the back pressure cylinder and the material to be printed and, accordingly, the web velocity of the material to be printed is equal to the peripheral speed of the back pressure cylinder. In the ideal case, the peripheral speed of the back pressure cylinder and thus also the web speed of the material to be printed are identical with the peripheral speed of the impression cylinder, so that the image to be printed is transferred cleanly to the material to be printed.

For numerous conventional flexographic printing presses, the color printing unit is driven by a central wheel, which is fixed to the shaft of the back pressure cylinder, meshes with the impression cylinder gearwheels of all color printing units and the radius of the rolling circle of which is equal to the external radius of the impression cylinder (plus the thickness of the material to be printed), so that any slippage between the impression cylinder and the material to be printed is avoided.

Since the transmission ratio between the impression cylinder and the back pressure cylinder can assume only discrete values corresponding to the ratio of the number of cogs of the impression cylinder gearwheel to those of the central wheel, only discrete values can be selected in this case also for the circumference of the impression cylinder, namely, whole number multiples of U/Z, where U is the circumference of the back pressure cylinder and Z is the number of cogs of the central wheel. The circumference of the impression cylinder determines the so-called printing length, that is, the length of the printed images, which are produced by rolling the impression cylinder on the material to be printed and repeated in the longitudinal direction of the material to be printed.

If the material printed runs on continuously to a downstream processing station, such as a punching machine, which is to operate with accurate registration with the printed image, the printed length must agree accurately with the working length of the downstream processing station.

For many practical applications, the working length of the downstream machine is fixed by the requirements of the product. For example, it is frequently desirable that sheets of a specified length, which in each case carry a single printed image with accurate registration, are punched out of the printed sheet with the help of a punch. In this case, therefore, the printed length would have to be adapted to the desired sheet length. In this connection, however, it is frequently a problem that the printed length can be adapted only in discrete steps.

In practice, one has hitherto been able to manage by bringing about a certain selective slippage between the impression cylinder and the material being printed on the back pressure cylinder, while the applicator roll continues to roll without slippage on the impression cylinder. The circumferential speed of the impression cylinder then is slightly different from the circumferential speed of the back pressure cylinder and, during the transfer to the material to be printed, the image is smeared in a controlled manner, so that the actual printing length differs from the circumference of the impression cylinder by the slippage factor S, which is given by the ratio of the circumferential speed of the impression cylinder to that of the back pressure cylinder. The printing length is then adjusted coarsely by selecting an impression cylinder gearwheel with a suitable number of cogs and an impression cylinder with an appropriate circumference, and finely by way of the slippage factor S.

For this procedure, it must, of course, be possible to vary the rpm of the impression cylinder to that of the back pressure cylinder infinitely. For this purpose, a flexographic printing press is described in the European publication 0 459 98 A1 and the German publication 33 36 792 C2, for which a special driving mechanism is provided for the color printing units. This driving mechanism permits the rpm of the impression cylinder to be varied relative to the rpm of the back pressure cylinder. For this known flexographic printing press, the shaft of the back pressure cylinder carries two central wheels of identical construction. One of these central wheels is fixed to the shaft of the back pressure cylinder and serves to drive the back pressure cylinder, while the second central wheel is seated rotatably on the shaft of the back pressure cylinder and serves to drive the impression cylinder gearwheels. The two central wheels are coupled together by a differential, over which an additional rpm can be fed in by means of a suitable auxiliary driving mechanism. With the help of this auxiliary driving mechanism, the rpm of the impression cylinder can then be controlled independently of the back pressure cylinder.

OBJECTS AND SUMMARY OF THE INVENTION

It is an object of the invention to provide a flexographic printing press, for which the printing length can be varied infinitely without slippage between the impression cylinder and the material being printed.

Pursuant to the invention, each applicator roll of the flexographic printing press of the type mentioned above can be driven over a gear assembly with a fixed transmission ratio by a central wheel fixed on the shaft of the back pressure cylinder. The rpm of the impression cylinder thus is independent not only of the rpm of the back pressure cylinder, but also of the rpm of the applicator rolls and the fixed transmission ratio between the central wheel and the applicator rolls ensures that the circumferential speed of the applicator rolls is always identical with that of the back pressure cylinder or of the material being printed. Pursuant to the invention, the printing length is selected by selecting an impression cylinder with a suitable diameter. In general, the circumference of the impression cylinder will therefore be a multiple of U/Z, which is not a whole number. The separate driving mechanism for the impression cylinder is controlled so that the circumferential speed of the impression cylinder is also identical with the circumferential speed of the back pressure cylinder and consequently also with the circumferential speed of the applicator roll. There is therefore no slippage between the impression cylinder and the material being printed or between the impression cylinder or the applicator roll and the printing length is determined only by the circumference of the impression cylinder. This has the advantage that a printing image, which is not smeared and therefore clean, is obtained for each printing length, which can be selected infinitely variably.

In a preferred embodiment, the impression cylinder is driven over a second central wheel, which is seated rotatably on the shaft of the back pressure cylinder and meshes with the gearwheels of the impression cylinders of all color printing units. The gear assemblies for the driving mechanism of the applicator rolls are then preferably formed in each case by an intermediate gearwheel, which is seated so as to freewheel on the shaft of the impression cylinder and meshes on the one hand with the central wheel, which is fixed to the shaft of the back pressure cylinder and, on the other, with the gearwheel of the applicator roll. This intermediate gearwheel preferably has the same rolling circle and the same number of cogs as the gearwheel of the impression cylinder. By these means, a particularly simple and compact construction of the whole driving system and rational manufacture of the various transmission elements are made possible. The printing length can be changed in a particularly rational manner for this embodiment owing to the fact that the impression cylinder, together with the respectively associated impression cylinder gearwheel and intermediate gearwheel are simply exchanged. Since the gearwheels mentioned are seated on the shaft of the impression cylinder, they, together with the impression cylinder, form a unit, which can be handled without problems when the impression cylinder is changed.

When the impression cylinder is exchanged for one with a different circumference and, consequently, also with a different diameter for changing the printing length, then the axial distances between the impression cylinder and the back pressure cylinder on the one hand and between the impression cylinder and the applicator roll on the other necessarily also change. So that the meshing between the different gearwheels is retained even for larger changes in the axial distances, the gearwheel of the impression cylinder and the intermediate gearwheel are in each case dimensioned so that the diameter of their rolling circle comes as close as possible to the diameter of the impression cylinder. For infinitely variable printing lengths, certain diameter differences generally still remain. However, these can be compensated for by a larger or smaller bottom clearance of the mutually meshing gearwheels.

Pursuant to an advantageous further development of the invention, the axial distances are adjusted by an appropriate shift of the profiles of the impression cylinder gearwheel and of the intermediate gearwheel. Satisfactory gearwheel meshing can be ensured by this measure and a relatively large range of diameters of the impression cylinder can be covered with a specified number of cogs of the impression cylinder gearwheel and of the intermediate gearwheel. Since the impression cylinder gearwheel and the intermediate gearwheel generally remain on the shaft of the associated impression cylinder, the shift in the profiles can be adapted in each case particularly to the diameter of the impression cylinder in question.

Pursuant to a preferred embodiment of the invention, the two gearwheels, which are seated on the shaft of the back pressure cylinder and one of which drives the back pressure cylinder and the applicator rolls and the other the impression cylinders, are in each case driven directly by an associated electric motor and the rpm of at least one of these electric motors is controlled so that the desired ratio between the rpm of the back pressure cylinder and the rpm of the impression cylinder is brought about. By these means, the construction of the transmission unit is simplified further, since the two central wheels do not have to be coupled together by a differential. This design thus makes possible a more compact construction of the gear unit, a decrease in weight and a decrease in the moment of inertia of the masses that are to be driven which, in turn, reduces the energy losses, the wear and the development of noise. Moreover, the two central wheels and the associated gear trains can in this way be driven independently of one another at any rpm. If, for example, the color printing units are brought into the inoperative position and only the back pressure cylinder is to be driven, it is only necessary to switch off the driving mechanism for the impression cylinder without having to actuate any couplings. In this case, the applicator rolls do not run because, in the inoperative position of the color printing units, the intermediate gearwheels do not mesh with the associated central wheel.

The last-mentioned measure, that is, the independent direct driving of the two central wheels by associated electric motors without coupling the two central wheels by a differential, is also of advantage for a flexographic printing press not realized.

BRIEF DESCRIPTION OF THE DRAWINGS

In the following, a preferred example of the invention is explained in greater detail by means of the drawing, in which.

DESCRIPTION OF THE PREFERRED EMBODIMENTS

Figure 1:
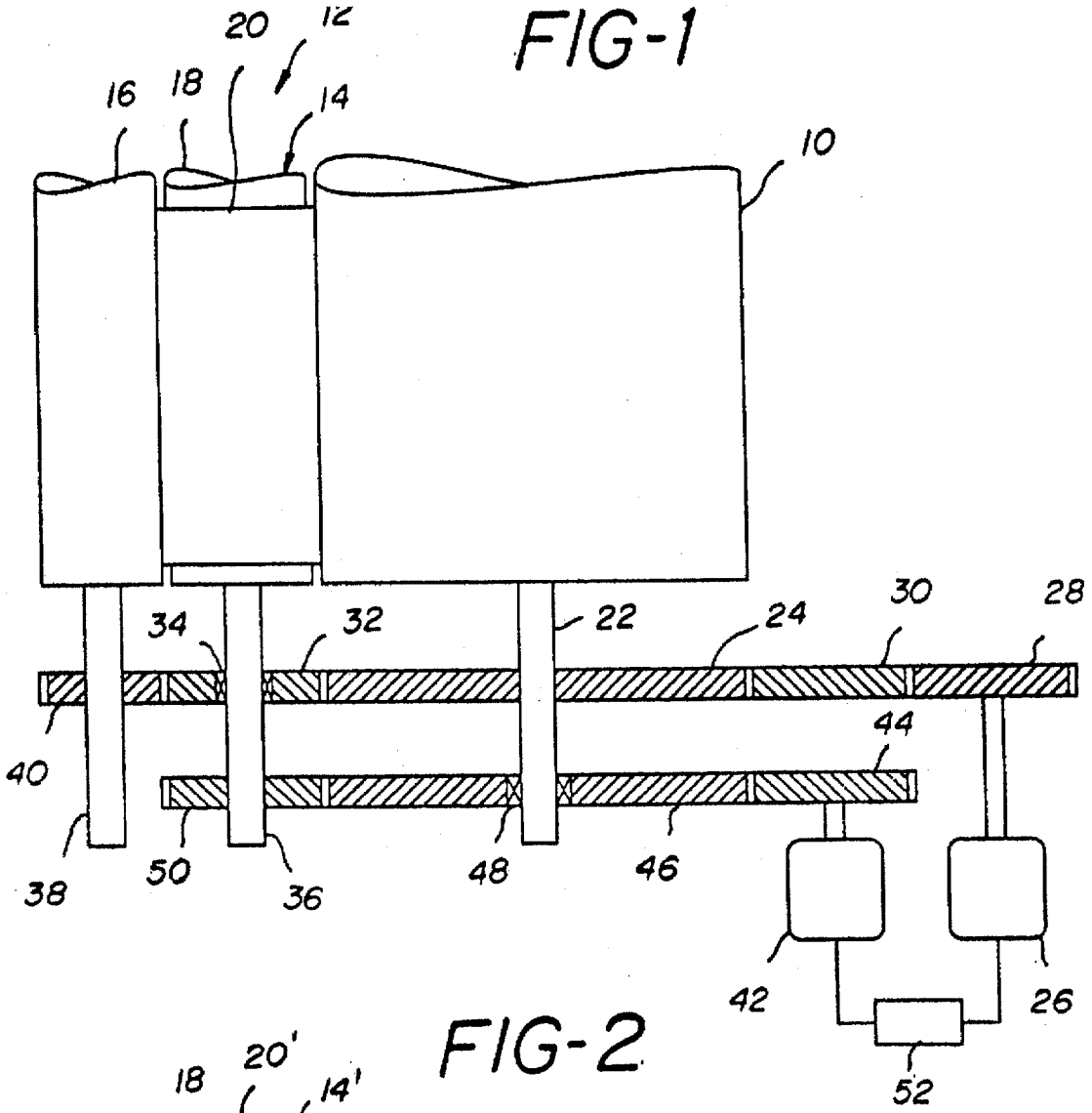
FIG. 1 shows a diagrammatic representation of the driving mechanism of a flexographic printing press and FIG. 2 shows a diagrammatic representation of the essential parts of FIG. 1, for the case in which the flexographic printing press is set up for a printing length different from that of FIG. 1.

At the periphery of a back pressure cylinder 10, several color printing units 12 are disposed, of which only one is shown in FIG. 1. The color printing unit 12 has an impression cylinder 14 and an applicator roll 16. The impression cylinder has a cylindrical core 18, on the periphery of which a printing plate 20 is clamped, the outer surface of which forms the block corresponding to the desired printed image and determines the effective diameter as well as the effective circumference of the impression cylinder.

In the operating position, the outer surfaces of the back pressure cylinder 10, the impression cylinder 14 and the applicator roll 16 are in contact with one another and the back pressure cylinder, the impression cylinder 14 and the applicator roll 16 rotate about their respective axes with the same circumferential speed. However, the peripheral surface of the applicator roll 16, provided with a grid of cells, passes through the inking chamber of a "Kammerakel" (literally:

comb doctor blade), which is not shown, and, in the course of rotating further, transfers the ink taken up to the impression cylinder 14. From the impression cylinder 14, the printing ink is transferred to the printing parts of the (not shown) material to be printed, which loops the back pressure cylinder 10.

A first central wheel 24, which is driven by an electric motor 26, is fixed to the shaft 22 of the back pressure cylinder 10. In the examples, shown the drive train between the central wheel 24 and the electric motor 26 which comprises a gearwheel 28, which is seated on the output shaft of the electric motor, and a further gearwheel 30, which meshes with the gearwheel 28 and with the central wheel 24. Alternately, the gearwheel 28 may also be disposed on the periphery of the central wheel 24, so that it meshes directly with the central wheel. In this case, the gearwheel 30 can be omitted and the electric motor 26 is driven in the opposite direction of rotation.

The central wheel 24 furthermore meshes with a free-wheeling intermediate gearwheel 32 which, with the help of a bearing 34, is disposed rotatably on the shall 36 of the impression cylinder 14. The intermediate gearwheel 32, in turn, meshes with an applicator gearwheel 40, which is fixed to the shaft 38 of the applicator roll 16.

The rolling circle diameter of the central wheel 24 is identical with the external diameter of the back pressure cylinder 10. Likewise, the rolling circle diameter of the intermediate gear wheel 32 and the external diameter of the impression cylinder 14 as well as the rolling circle diameter of the applicator roll gearwheel 40 and the diameter of the applicator roll are identical. The back pressure cylinder 10 and the applicator roll 16 are driven by the electric motor 26, the transmission ratio being fixed by the ratio of the number of cogs of the applicator roll gearwheel 40 and of the central wheel 24. The ratio of the diameters and circumferences of the applicator roll 16 and the back pressure cylinder 10 corresponds to this transmission ratio, so that the applicator roll 16 has the same circumferential speed as the back pressure cylinder 10.

For driving the impression cylinders 14 of all color printing units 12, a separate electric motor 42 is provided, the output gearwheel 44 of which meshes with a second central wheel 46, which is mounted rotatably with the help of a bearing 48 on the shaft 22 of the back pressure cylinder 10. The second central wheel 46, in turn, meshes with an impression cylinder gearwheel 50, which is fixed to the shaft 36 of the impression cylinder.

In the example shown, the gear rims of the two central wheels 24 and 46 are identical. The gear rim of the impression cylinder gearwheel 50 is identical with the gear rim of the intermediate gearwheel 32. In the situation shown in FIG. 1, the diameter of the rolling circle of the impression cylinder gearwheel 50 thus also corresponds to the diameter of the impression cylinder 14. The transmission ratio between the impression cylinder 14 and the second central wheel 46 is given by the ratio between the number of cogs of the impression cylinder gearwheel 50 and of the second central wheel 46 and the ratio between the circumference of the impression cylinder 14 and the circumference of the back pressure cylinder 10 corresponds to this transmission ratio. Consequently, the circumferential speed of the impression cylinder 14 is identical with the circumferential speed of the applicator roll 16 and of the back pressure cylinder 10, when the second central wheel 46 is driven at the same rpm as the first central wheel 24. For this purpose, the two electric motors 42 and 26 are synchronized by an electronic control system 52.

However, under these conditions, the printing length, which is determined by the circumference of the impression cylinder 14, can assume only discrete values, since the ratio of the circumference of the impression cylinder 14 to that of the back pressure cylinder must always correspond to the ratio of two whole numbers, namely the ratio of the number of cogs of the impression cylinder gearwheel 50 to that of the second central wheel 46.

Figure 2:
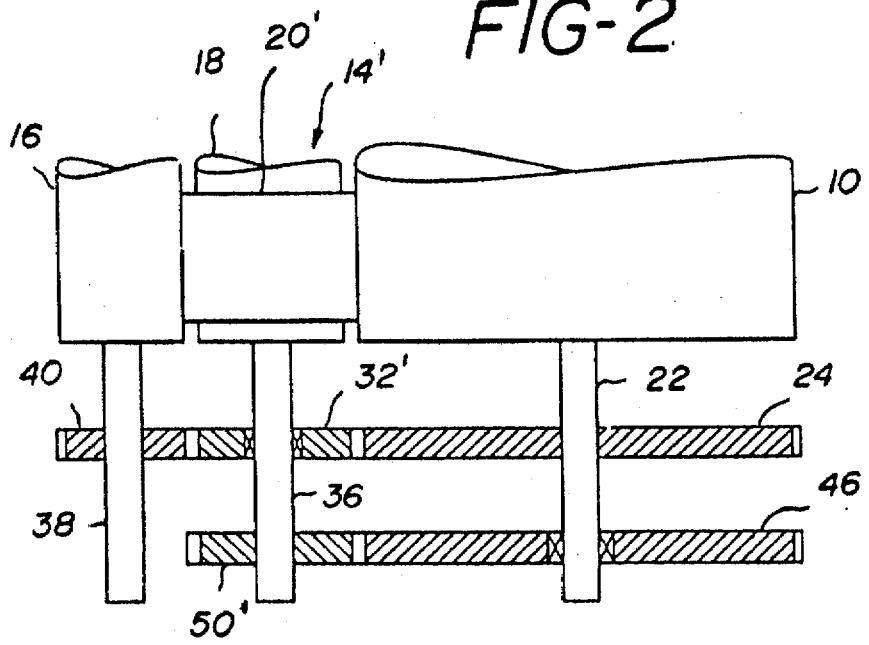

If a printing length deviating from these discrete values is desired, the impression cylinder 14, pursuant to the invention, is replaced by an impression cylinder 14' with a different external diameter, as shown in FIG. 2. In that example, the core 18 of the impression cylinder remains unchanged, the only difference being that the printing plate 20', which is clamped in place, has a greater thickness. Alternately, the thickness of the printing plates can also, however, be left unchanged and the core 18 of the impression cylinder varied.

When the impression cylinder 14' is exchanged, the gearwheels, seated on the shaft 36 of the impression cylinder 14', are also exchanged. Instead of the intermediate gearwheel 32, an intermediate gearwheel 32' with a crown circle of larger diameter is provided; correspondingly, the impression cylinder gearwheel 50 of FIG. 1 is replaced in FIG. 2 by an impression cylinder gearwheel 50' with a crown circle of larger diameter.

As an example, it is assumed that the difference between the printing lengths of the situations shown in FIGS. 1 and 2 is less than the distance between the discrete values, which correspond to the possible number of cogs of the intermediate gearwheel 32 and of the impression cylinder gearwheel 50. The intermediate gearwheel 32' in FIG. 2 therefore has the same number of cogs as the intermediate gearwheel 32 in FIG. 1 and this corresponding also applies for the impression cylinder gearwheels 50 and 50'. Since the transmission ratio in FIG. 2 accordingly is the same as that in FIG. 1, the impression cylinder 14' would run at too high a circumferential speed if the central wheels 24 and 46 would be driven with the same rpm. Therefore, in the case shown in FIG. 2, the ratio of the rpm of electric motor 26 to that of electric motor 42 is controlled with the help of the control system 52 in such a manner, that the circumferential speed of the impression cylinder 14' is kept identical with the circumferential speeds of the applicator roll 16 and of the back pressure cylinder 10. A slippage-free rolling of the impression cylinder 14 on the applicator roll 16 as well as on the back pressure cylinder 10 is thus ensured also for the printing length selected in this way in FIG. 2, which printing length does not correspond to a discrete ratio of the number of cogs.

Because of the larger diameter of the impression cylinder 14', the distance between the shafts 36 and 22, as well as the distance between the shafts 36 and 38 is in each case greater in FIG. 2 than in FIG. 1. In order to ensure that the intermediate gearwheel 32' and the impression cylinder gearwheel 50' nevertheless mesh satisfactorily with the assigned gearwheels, a (positive) profile shift is provided for the intermediate gearwheel 32' and the impression cylinder gearwheel 50'. Accordingly, while the number of cogs is the same, the diameter of the crown circle of these gearwheels is enlarged in such a manner, that a sufficiently deep cog engagement with the opposite gearwheels is ensured and the involute profiles are changed in a known manner, so that the cog profiles roll satisfactorily on one another, although the axial distances between the mutually meshing gearwheels are larger here than the sums of the radii of their rolling circles.

If an even larger printing length is required, for which the ratio of the circumference of the impression cylinder 14' to that of the back pressure cylinder 10 is closer to the next higher ratio of cog wheels, the intermediate gearwheel 32' and the impression cylinder gearwheel 50' are replaced by gearwheels which, in each case, have an additional cog. If the axial distance, determined by the diameter of the impression cylinder, is less than the sum of the radii of the rolling circles, a negative profile shift is employed, so that the gearwheels mesh satisfactorily with adequate bottom clearance.

What is claimed is:

1. A flexographic comprising:

a common back pressure cylinder having a shaft, at least one color printing unit, each of which is disposed at a periphery of the common back pressure cylinder and each of which includes:

an impression cylinder and an applicator roll, the impression cylinder being driven independently of the back pressure cylinder, a central wheel fixed on the shaft of the back pressure cylinder, and a gear assembly interposed between the central wheel and each applicator roll such that each applicator roll is driven via the gear assembly with a fixed transmission ratio by the central wheel fixed on the shaft of the back pressure cylinder.

2. The flexographic printing press of claim 1, wherein the central wheel has a rolling circle diameter which is identical with an external diameter of the back pressure cylinder, further comprising:

a shaft of the applicator roll, an applicator gearwheel having a rolling circle with a diameter which is identical with an external diameter of the applicator roll, the applicator gearwheel being fixed to the shaft of the applicator roll and wherein said gear assembly includes an intermediate gearwheel which couples together the central wheel and the gearwheel of the applicator roll.

3. The flexographic printing press of claim 2, wherein the impression cylinder includes a shaft, and the intermediate gearwheel is disposed in a freewheeling manner on the shaft of the impression cylinder.

4. The flexographic printing press of claim 3, wherein the impression cylinder and the intermediate gearwheel, which is seated on the shaft of the impression cylinder, in each case form an exchangeable unit.

5. The flexographic printing press of claim 1, wherein the circumference of the impression cylinder is different from every whole-number multiple of U/Z, U being the circumference of the back pressure cylinder and Z the number of cogs of the central wheel.

6. The flexographic printing press of claim 4, wherein the intermediate gearwheels of different units in each case have the same number of cogs, but different profile shifts corresponding to different distances between an axis of the impression cylinder and an axis of the back pressure cylinder as well as between the axis of the impression cylinder and an axis of the applicator roll.

7. The flexographic printing press of claim 1, further comprising:

an impression cylinder gearwheel mounted on a shaft of the impression cylinder, a second central wheel, which is disposed rotatably on the shaft of the back pressure cylinder and meshes with the impression cylinder gearwheel fixed on the shaft of the impression cylinder of each color printing unit, two electric motors, each for driving one of the two central wheels, and an electronic control system which controls the rpm of the electric motors to a specified rpm ratio.

8. The flexographic printing press of claim 7, wherein:

said gear assembly includes an intermediate gearwheel seated on the shaft of the impression cylinder, the second central gearwheel has the same toothing as the first central gearwheel and the impression cylinder gearwheel in each case has the same toothing as the intermediate gearwheel, seated on the same shaft of the impression cylinder.

* * * * *